US008696481B1

(12) United States Patent
Allen

(10) Patent No.: US 8,696,481 B1
(45) Date of Patent: Apr. 15, 2014

(54) LONG PUTTER BRACE ASSEMBLY

(71) Applicant: Dillis V. Allen, Schaumburg, IL (US)

(72) Inventor: Dillis V. Allen, Schaumburg, IL (US)

( * ) Notice: Subject to any disclaimer, the term of this patent is extended or adjusted under 35 U.S.C. 154(b) by 0 days.

(21) Appl. No.: 13/629,959

(22) Filed: Sep. 28, 2012

(51) Int. Cl.
*A63B 69/36* (2006.01)

(52) U.S. Cl.
USPC ..... 473/208; 473/215

(58) Field of Classification Search
USPC ..... 473/207, 208, 215, 216, 219, 226, 227, 473/229, 257, 266, 274–277
See application file for complete search history.

(56) References Cited

U.S. PATENT DOCUMENTS

| | | | | | |
|---|---|---|---|---|---|
| 4,399,994 | A * | 8/1983 | Hourihan | 473/208 |
| 4,509,757 | A * | 4/1985 | Yuhara | 473/215 |
| 4,582,325 | A * | 4/1986 | Yuhara | 473/215 |
| 5,150,901 | A * | 9/1992 | Stawicki | 473/215 |
| 5,342,055 | A * | 8/1994 | Diley | 473/208 |
| 5,441,271 | A * | 8/1995 | Briggs | 473/215 |
| 5,649,870 | A * | 7/1997 | Harrison | 473/239 |
| 6,447,402 | B2 * | 9/2002 | Moran | 473/226 |
| 6,659,880 | B1 * | 12/2003 | Hsieh | 473/226 |

* cited by examiner

*Primary Examiner* — Nini Legesse
(74) *Attorney, Agent, or Firm* — Dillis V. Allen, Esq.

(57) ABSTRACT

A golfer body attached brace assembly for restricting motion of a long putter end to a fixed axis path with respect to the golfer's body including a base fixed to a frontal portion of the golfer's body with a pivotal joint on the base attached to the butt end of the putter restricting motion of the putter end to the axis of the joint. The base is held against the body using, as an example, the golfer's head to rotate the base toward the body.

11 Claims, 7 Drawing Sheets

LONG PUTTER BRACE ASSEMBLY

BACKGROUND OF THE INVENTION

Considerable controversy has recently heightened over professional golfers' use of long putters anchored to the body by either impaling the butt end of the putter shaft into the golfer's abdomen (belly putter) or holding the butt end with one of the golfer's hands on the shaft butt end resting firmly against the central thoracic area of the golfer. These uses have been informally termed unfair advantages by golfing regulatory bodies (USGA and R&A) and may be ruled illegal for professional golfers at the time of the next rule changes, probably 2016.

Such rulings, however, have little influence over disabled golfers and amateurs in general. Amateur golfers around the world, particularly those over 30 years of age, usually develop what is called the "yips" in their putting strokes, an involuntary jerking motion, that sends the ball off line, short, or long the target—the hole.

Thus, a system that aids in the elimination of this problem will have substantial benefits for many millions of golfers around the world that value good play over technical and emotionally intrusive rules that apply only to the several hundred golfers playing upper level professional golf.

The following patents and patent publications have been found in a preliminary patent search:

| Inventor | Pat. No. | Issue Date |
|---|---|---|
| Candow | 5,024,438 | Jun. 18, 1991 |
| Beil | 5,125,657 | Jun. 30, 1992 |
| Voyer | 5,209,474 | May 11, 1993 |
| Diley | 5,342,055 | Aug. 30, 1994 |
| Martinez | 5,904,624 | May 18, 1999 |
| Schuster | 6,491,591 | Dec. 10, 2002 |
| D'Angelo, et al. | 6,533,676 | Mar. 18, 2003 |

U.S. Patent Publications

| Inventor | Pub. No. | Pub. Date |
|---|---|---|
| Hakas, et al. | 2003/0195057 | Oct. 16, 2003 |
| Keating | 2005/0054460 | Mar. 10, 2005 |

The Hakas, et al., U.S. Patent Pub. 2003/0195057, entitled "Golf Putter and Method of Putting" shows a long dual grip putter wherein the upper grip rests against the side of the golfer's neck.

The Keating, U.S. Patent Pub. 2005/0054460, entitled "Golf Putter and Training Apparatus and Method" shows another long putter pivoted against the forward side of the golfer's neck.

The Diley, U.S. Pat. No. 5,342,055, entitled "Golf Putting Training Device" shows a stabilizing hook 12 separate from the golf shaft.

The Voyer, U.S. Pat. No. 5,209,474 entitled "Elongated Golf Putter and Putting Method" shows an arm pivoted putter shaft.

The D'Angelo, et al., U.S. Pat. No. 6,533,676 entitled "Golf Putting Aid and Brace Member Therefor" shows an upper lever attached to the butt end of the putter 12.

The Schuster, et al., U.S. Pat. No. 6,491,591, entitled "Putter Stabilizing Brace for Putt Training" shows a mid shaft separate brace 2.

The Martinez, U.S. Pat. No. 5,904,624, entitled "Golf Putter Trainer" shows a club shaft brace that fits between the golfer's forearms.

The Beil, U.S. Pat. No. 5,125,657 entitled "Putter with Pendulum Action", and the Candow, U.S. Pat. No. 5,024,438, entitled "Detachable Golf Putter Extension, both show extensions attached to the butt end of the putter shaft.

It is a primary object of the present invention to ameliorate the problems noted above in restricting a golfer's movement of the putter to rotate about an axis fixed with respect to the golfer's body.

SUMMARY OF THE PRESENT INVENTION

In accordance with the present invention, a golfer mounted brace assembly is provided for restricting motion of a long putter end to a fixed axis path with respect to the golfer's body including a base fixed to a frontal portion of the golfer's body with a pivotal joint on the base attached to the butt end of the putter restricting motion of the putter end to the axis of the joint. The base is held against the body using, as an example, the golfer's head to rotate the base toward the body. Other body movement could also be used to rotate the base toward the body such as arm movement, thoracic movement and other body movements, or devices such as straps. But straps are not the preferred method.

The brace includes a "U" shaped collar that guides the brace assembly around the golfer's neck as he or she prepares to putt.

The pivotal joint is a universal ball and socket connection that limits pivotal movement of the putter to the center of the ball and socket.

The base is held against the body by a jaw actuated cradle that is fixedly attached to the base so that as the golfer bends his head downwardly, the cradle rotates the base against the golfer's thorax, holding it in a fixed position relative to the body during the putting stroke. That function also assists in maintaining the golfer's head still during the putter stroke, which is extremely important.

Others objects and advantages will appear more clearly from the following detailed description.

DETAILED DESCRIPTION OF THE PREFERRED EMBODIMENTS

Figure 1:
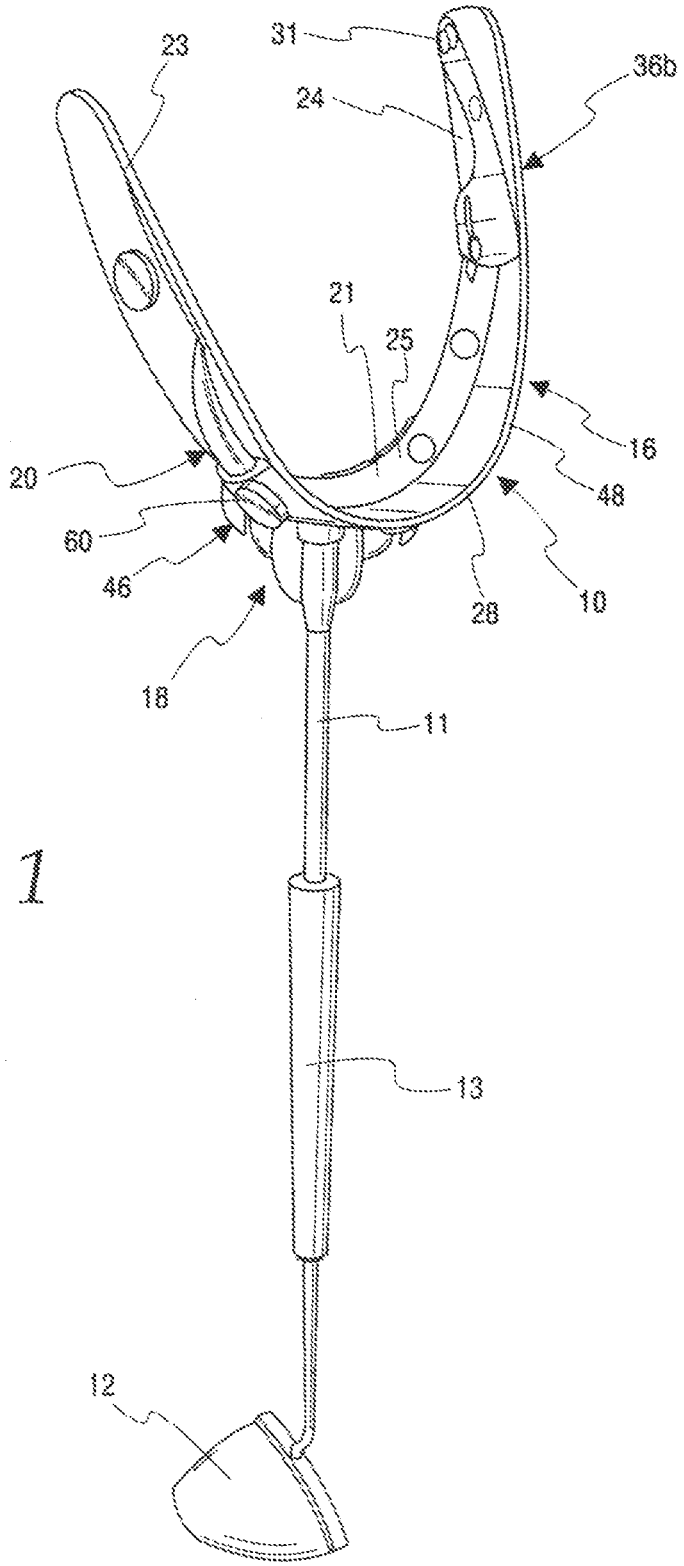
FIG. 1 is a left front perspective of the present long putter brace assembly attached to the butt end of a long putter.
Figure 7:
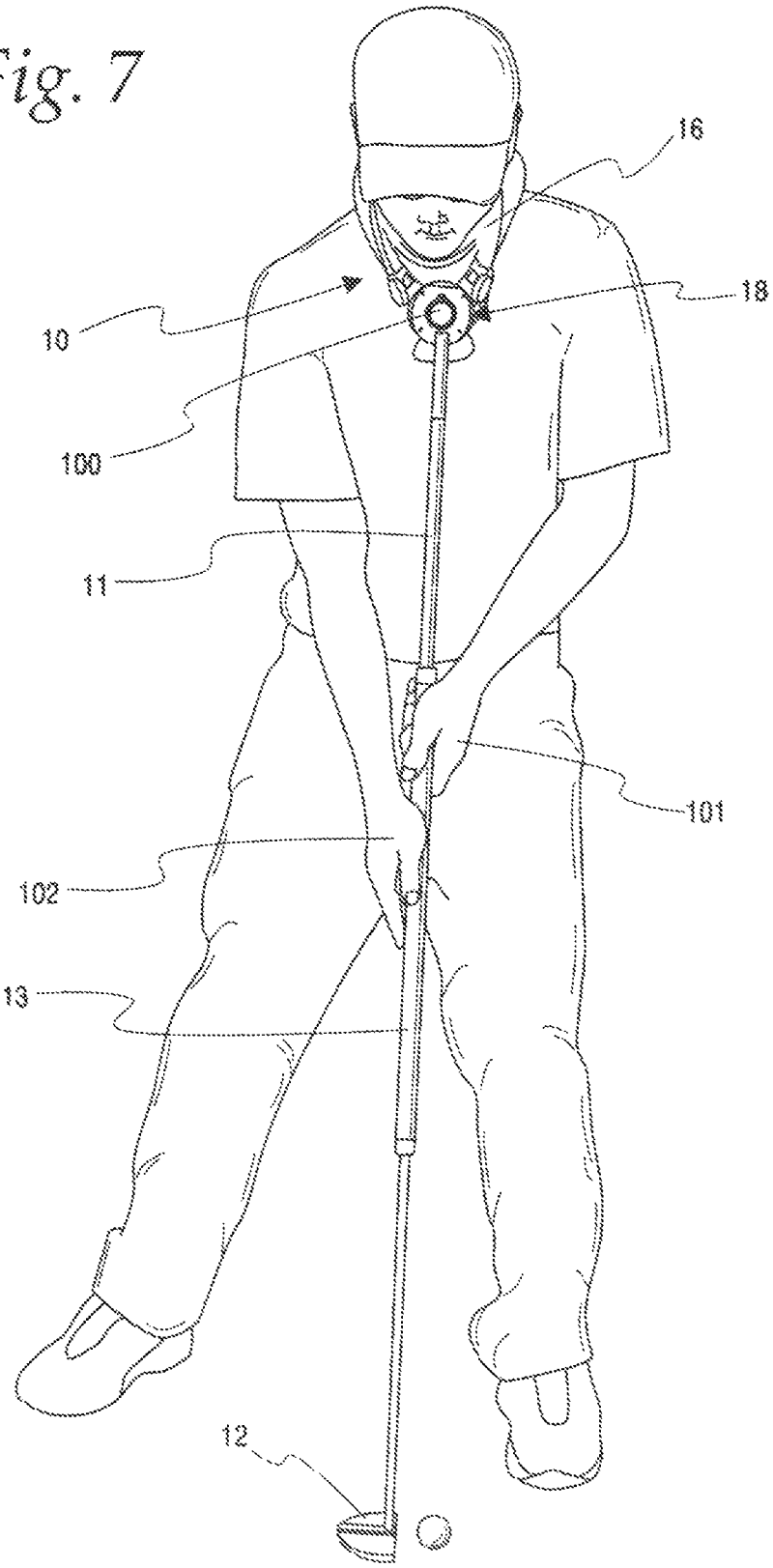
FIG. 7 is a front view of a golfer at the address position with the present long putter brace assembly fitted into his torso.
Figure 8:
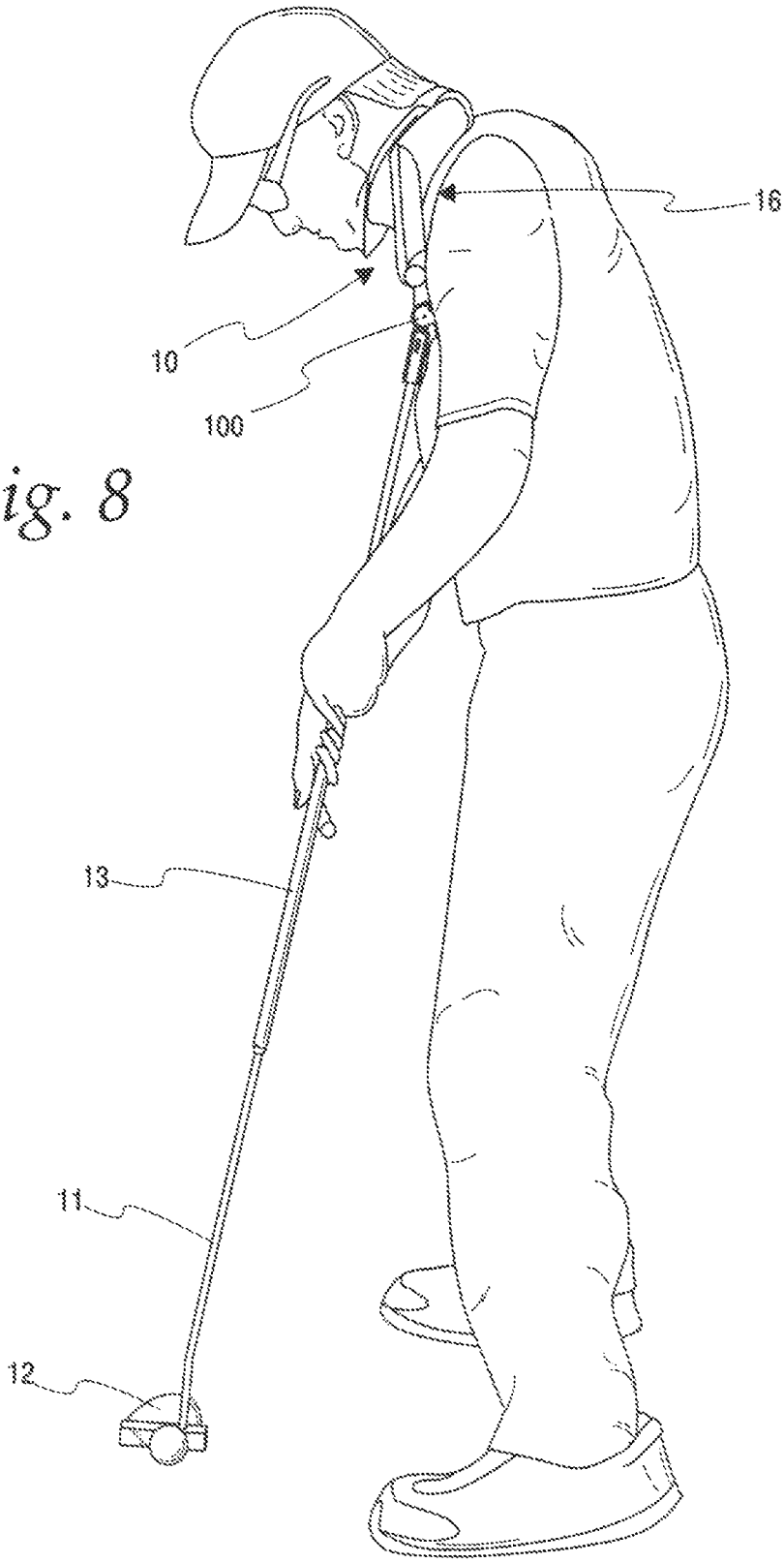
FIG. 8 is a right side view of a golfer at the address position with the present long putter brace assembly fitted into his torso.

Referring to the drawings and particularly FIGS. 1 to 5, the present long putter brace assembly is generally designated by the reference numeral 10 and in FIG. 1 is illustrated attached to the butt end of a long putter assembly 11 that consists of a tapered shaft 11, a mallet styled head 12, and a wrapped shaft grip 13. The grip 13 may be either round or irregular in cross-section and has a long length of about 23 inches to enable the golfer to place both hands on the grip as seen in FIGS. 7 and 8, without the golfer's upper hand acting as an anchor for the butt end of the shaft in a fashion conventional in present day long putters anchored in the upper thoracic region of the golfer's chest.

The present long putter brace assembly includes a collar assembly 16 that fits around the golfer's neck area that is locked in position by the golfer's head and jaw acting vertically downwardly and a universal joint assembly 18 that is forced to a fixed position against the golfer's upper thorax by the collar assembly 16.

The collar assembly 16 has a base assembly 20 that consists of a U-shaped frame 21 that wraps around the front of the golfer's neck having arm portions 23 and 24 connected by an integral bite portion 25.

Figure 3:
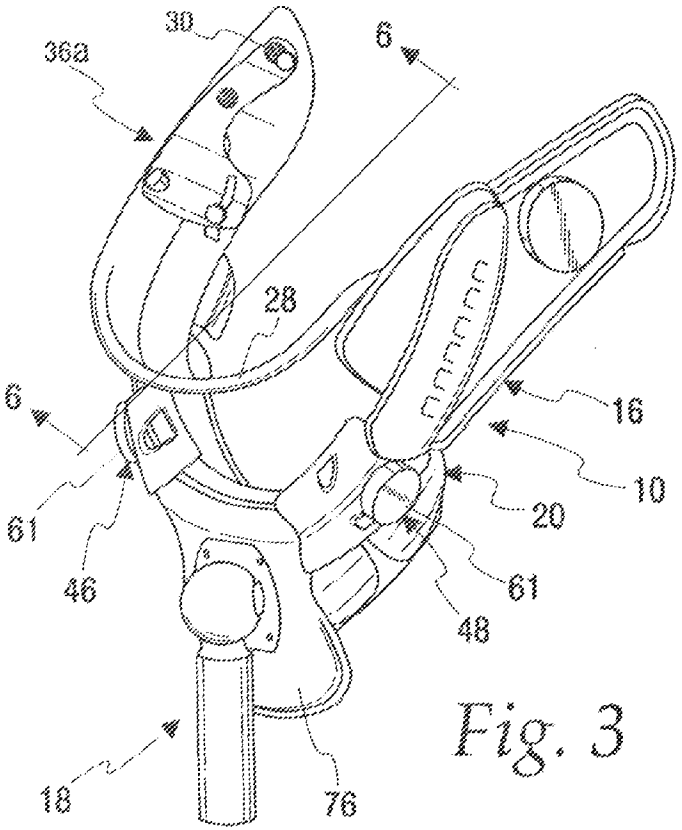
FIG. 3 is a right front perspective of the present long putter brace assembly.
Figure 6:
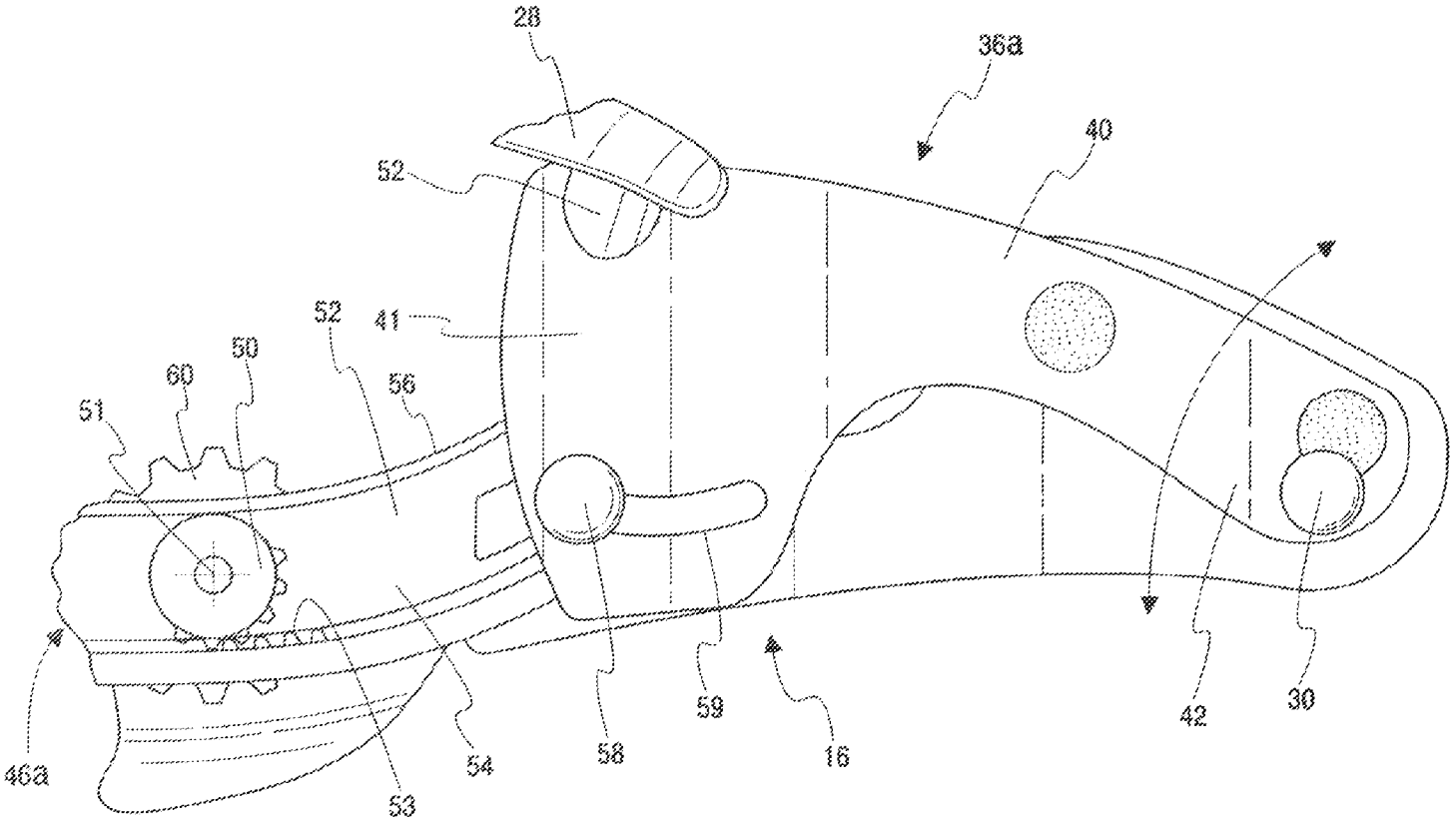
FIG. 6 is a side inside view of the jaw lever adjustment assembly taken generally along line 6-6—of FIG. 3.

A U-shaped jaw lever 28 is pivotally mounted to base arm plate 40 at 29 so the jaw lever may be adjusted upwardly and downwardly by jaw lever adjustment mechanisms 36*a* and 36*b* shown in FIGS. 1, 3 and 6.

The purpose of the jaw lever adjustment mechanism is to accommodate the individual putting posture of different golfers. More upright golfers will desire a larger angle between the jaw level 28 and the collar assembly 16, while golfers that bend over more while putting will desire a smaller angle between the jaw lever 28 and the collar assembly 16.

There is one adjustment mechanism 36*a* and 36*b* on each side of the collar assembly 16 so the jaw lever may be positioned in a variety of yaw angles about a horizontal axis extending throughout the golfer's neck perpendicular to the target line. This enables the jaw lever to conform to the tilt of many golfers heads at putting address, such as the great Jack Nicklaus.

Each adjustment mechanism 36*a* and 36*b* shown enlarged in FIG. 6, includes a curved arm plate 40 that has forward lobe 41 and rearward narrow lobe 42 pivoted at 30 to collar base arms 23 and 24. Arm plate 40 is pivoted to jaw lever 28 at 29 as plate 40 rotates up and down about pivot 30 the jaw level 28 rotates upwardly and downwardly.

The arm plates 40 are each pivoted by rack and pinion assemblies 46*a* and 46*b*. They are mirror images of one another and each is mounted for operation on the collar base arms 23 and 24.

Viewing FIG. 6, each rack and pinion assembly 46 includes an arcuate rack slide 52 with rack teeth 53 slidable in an outer sleeve 56 fixed to the outer sides of the collar arms 23 and 24. The slides 52 slide back and forth in the sleeves 56 by pinion gears 50 mounted on shafts 51, pivoted at 60 and 61. Slides 52 drive pins 58 in slots 59 to pivot plates 40 and each side of the jaw lever 28 up and down independently.

Figure 5:
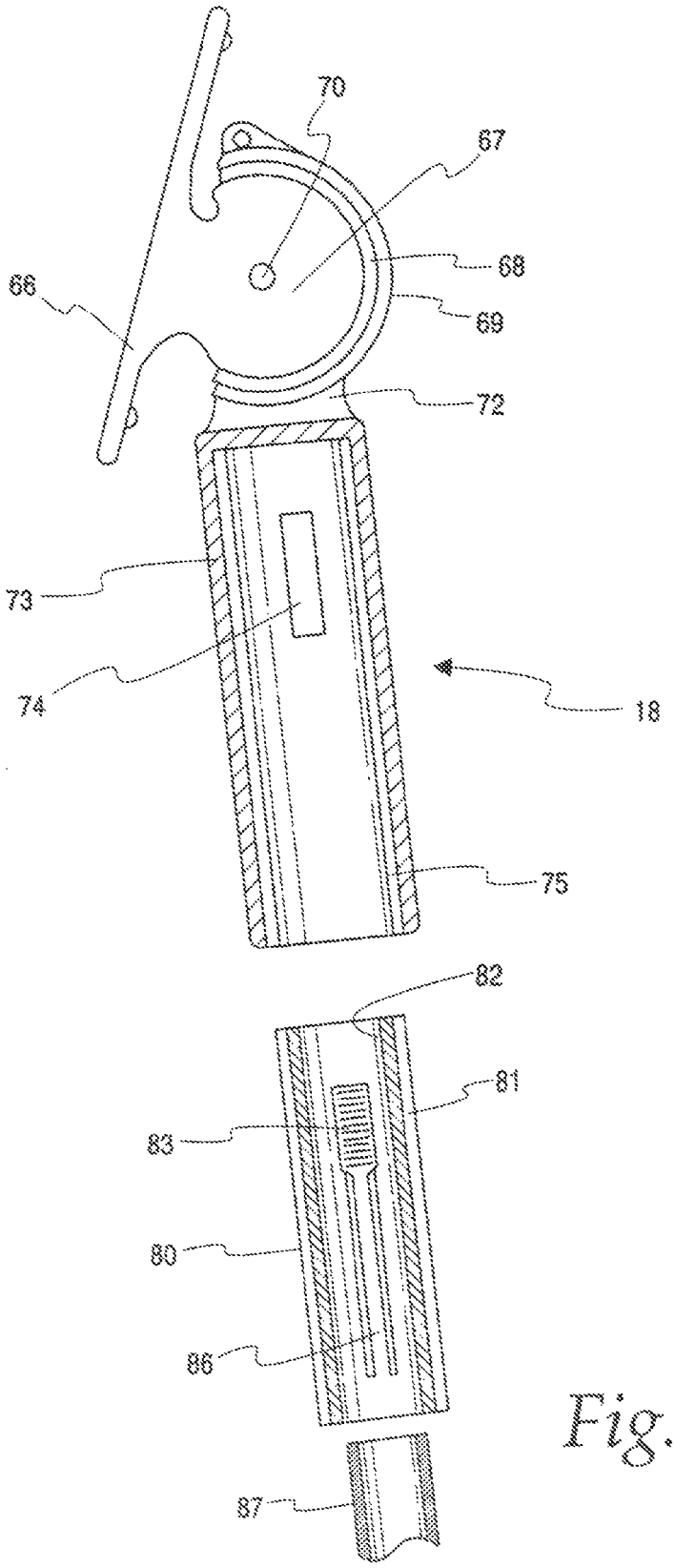
FIG. 5 is a right side view, partly in section, of the universal joint assembly.

The butt end of the putter shaft is pivotally mounted to the long putter brace assembly by the universal joint assembly 18 enlarged in FIG. 5. This restricts rotational motion of the butt end of the shaft to motion about a single point, rather than single or multiple planes.

The universal joint assembly 18 is fixedly mounted to thoracic plate 76 fixed into the collar base assembly 16 and rotated against the golfer's chest by the collar assembly 16.

The universal joint assembly 18 includes a base plate 66 fixed to the collar base plate 76, formed with an integral ball 67 upon which are mounted a nylon or teflon spheroidal bearing 68 and a spheroidal ball joint 69. Ball joint 69 is Titanium or Aluminum formed integrally with tubular sleeve 73 by a neck portion 72. Sleeve 73 has axial slot 75 to lock sleeve 80 rotationally while permitting sliding motion along grooves and slots 75 and 81. Sleeve 80, epoxied to shaft butt end 87, is axially locked to sleeve 73 by snap connectors 83, 86 and 74, known in the art.

Shaft butt 87 is epoxied into sleeve 80 and the snap connection to sleeve 73 permits the putter assembly to be removed from and reattached to the universal joint assembly either during or between golf rounds.

Figure 2:
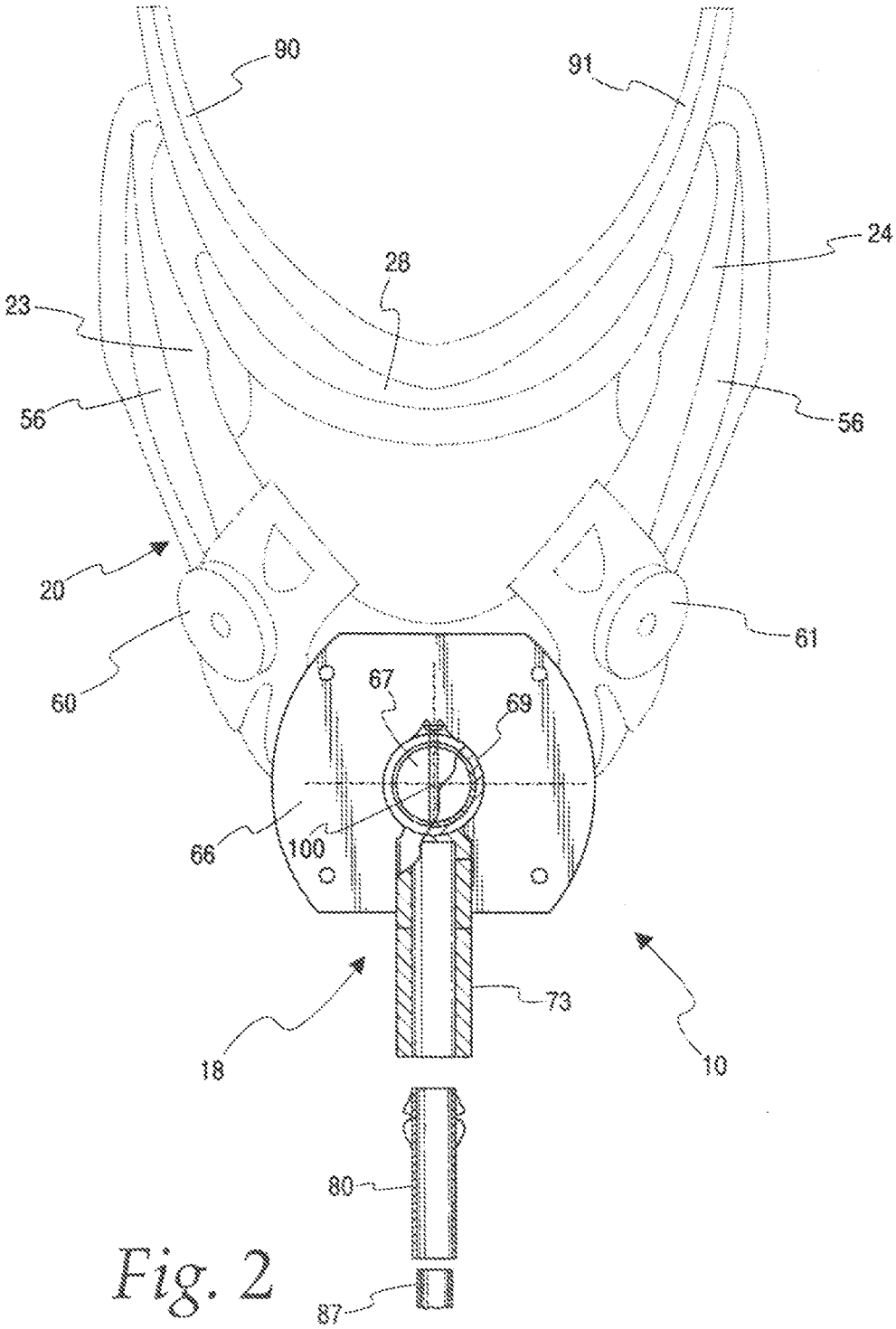
FIG. 2 is a front view of the present long putter brace assembly with the universal joint assembly shown partly in section.
Figure 4:
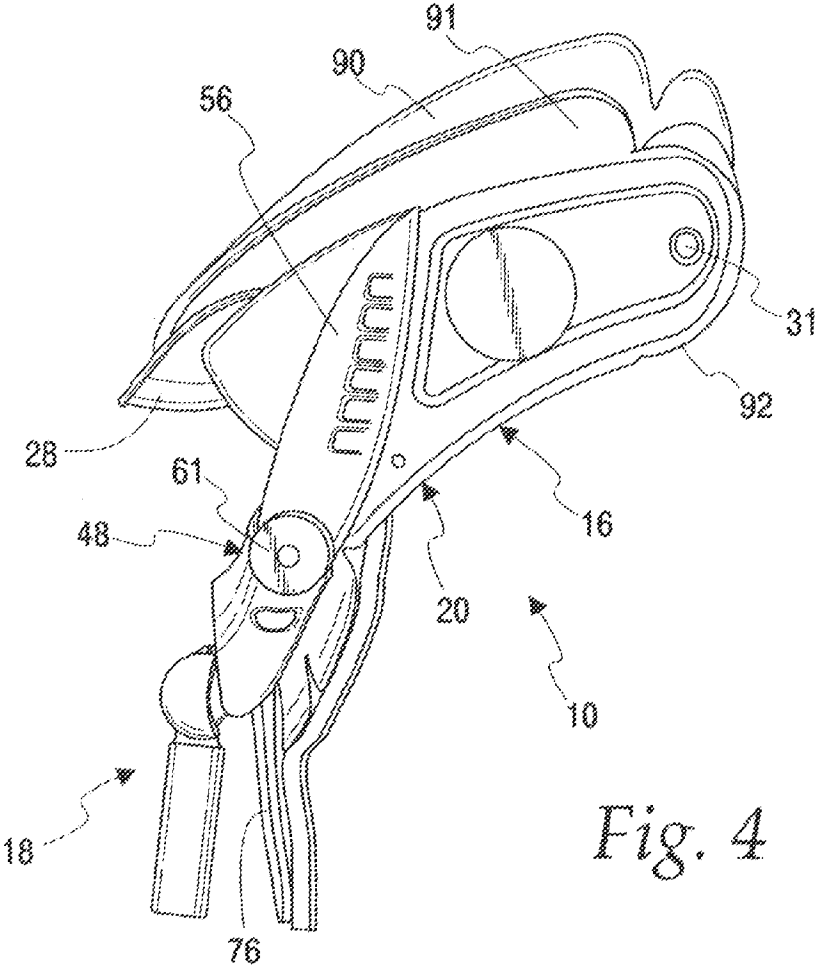
FIG. 4 is a right side view of the present long putter brace assembly.

It should be understood that in some of the drawing views that comfort pads cover the appearance of some of the underlying parts, such as pads 90, 91 and 92 in FIGS. 2 and 4.

FIGS. 7 and 8 show the long putter brace assembly 10 attached to the golfer's body and locking, without restriction of movement, the butt end of the golfer's putter shaft to pivotal movement about a single point 100. The golfer may remove the entire assembly 10 and the putter assembly as a unit from the golfer's bag or cart or may assemble the two after removal using the snap connector of the universal joint 18.

In either event, the golfer wraps the collar assembly 16 about the neck (and the collar is radially adjustable to fit different size necks and thorax), and addresses the ball on the green, or in a practice position, positions the head and jaw in an approximate midline central portion as shown in FIG. 7. The jaw lever angle shown in FIG. 8 should be pre-positioned prior to the round of golf to accommodate the golfer's posture and head tilt.

The golfer's jaw and head are then rotated downwardly, rotating the universal joint 18 located adjacent the golfer's chest downwardly to prevent movement of the axis point 100 of the universal joint 18 relative to the golfer's body. The universal joint 18 does not restrict the lie angle, offset angle or set up of the shaft rotation of the putting head.

The golfer places the forward hand 101 on the grip 13 and also places trailing hand 102 on the same grip, using a standard or reverse grip. Also, the lower axis hand 102 may be either standard or claw grip.

The important aspect of the present invention is that the upper hand on the shaft does not form the pivotal axis for the butt end of the butt end of the shaft as presently known.

Instead, the upper shaft hand is freed by the present design to be positioned at a lower controlling point on the putter shaft depending upon the individual golfer's preferences.

The benefits of the present invention cannot be honestly overstated here, they can be utilized by the millions of golfers who have experienced this miraculous transformation of the putting stroke for all those who have gone before with putting strokes hampered by physical disabilities of the legs, arms, spinal stenosis, crippling jerking movements, shaking hands and bodies, those all who love golf but for some malady or unintended imperfections, or even mental fear—cannot strike the putter head on a straight smooth path. This may not fix all, but to those who say nay, what do you say to the millions of amateur golfers vastly improved by this simple little putting helper.

The invention claimed is:

1. A golfer body mounted brace assembly for a long putter including a head, a shaft having a distal end connected to the head and a butt end connected to the brace assembly, comprising: a brace assembly for pivotally mounting the butt end of the putter shaft for pivotal movement about a fixed point relative to the golfer's thorax including a base releasably mounted in a fixed position on a frontal portion of the golfer's body, and a pivotal joint having a pivotal axis point closely adjacent and fixed with respect to the golfer's thorax and having a first end connected to the base and a second end connected to the butt end of the putter shaft, wherein the base is generally "U" shaped to fit around a frontal portion of a neck of the golfer.

2. A golfer body mounted brace assembly for a long putter as defined in claim 1, including a lever fixedly connected to the base at one end and engaging a jaw portion of the golfer at another end.

3. A golfer body mounted brace assembly for a long putter as defined in claim 2, wherein the lever is shaped to conform to the golfer's jaw and is adjustable relative to the base.

4. A golfer body mounted brace assembly for a long putter including a head, a shaft having a distal end connected to the head and a butt end connected to the brace assembly, comprising: a brace assembly mounted in a thoracic portion of the golfer's body including a base adapted to be mounted on the thoracic portion of the golfer's body, a pivotal joint adapted to provide restricted motion of the putter while restricting its motion to pivot about a fixed axis having a first end connected to the base and a second end connected to the butt end of the putter shaft, and means for holding the base against the thoracic portion including a lever fixed with respect to the base and positioned to be operated by the golfer's body.

5. A golfer body mounted brace assembly for a long putter as defined in claim 4, wherein the pivot joint is a universal connection permitting movement of the putter shaft in two orthogonal directions while restricting rotation of the putter to a fixed axis.

6. A golfer body mounted brace assembly for a long putter as defined in claim 4, wherein the base is generally "U" shaped to guide the base around the golfer's neck as the golfer mounts the brace assembly to the golfer's body.

7. A golfer body mounted brace assembly for a long putter as defined in claim 4, wherein the lever is configured to fit under the golfer's jaw so the golfer's head as it pivots downwardly forces the base against the golfer's thoracic portion.

8. A golfer body mounted brace assembly for a long putter including a head, a shaft having a distal end connected to the head and a butt end connected to the brace assembly, comprising: a brace assembly mounted in a thoracic portion of the golfer's body including a base adapted to be mounted on the thoracic portion of the golfer's body, a pivotal joint adapted to provide restricted motion of the putter while restricting its motion to pivot about a fixed axis having a first end connected to the base and a second end connected to the butt end of the putter shaft, and golfer's head operated means for holding the base against the thoracic portion.

9. A golfer body mounted brace assembly for a long putter as defined in claim 8, wherein the golfer's head operated means includes a cradle member fixed to the base and engaging the golfer's jaw so as the golfer tilts its head downwardly the cradle forces the base against the thoracic portion.

10. A golfer body mounted brace assembly for a long putter as defined in claim 8, wherein the pivot joint is a universal connection permitting movement of the putter shaft in two orthogonal directions while restricting rotation of the putter to a fixed axis.

11. A golfer body mounted brace assembly for a long putter as defined in claim 8, wherein the base is generally "U" shaped to guide the base around the golfer's neck as the golfer mounts the brace assembly to the golfer's body.

* * * * *